US007399948B2

(12) United States Patent
Brun et al.

(10) Patent No.: US 7,399,948 B2
(45) Date of Patent: Jul. 15, 2008

(54) PTC HEATING UNIT SUITABLE FOR USE IN MOTOR VEHICLES

(75) Inventors: Michel Brun, Rustenhart (FR); Christophe Schmittheisler, Epfig (FR); Pascal Miss, Selestat (FR); Maxime Mundel, Pfaffenheim (FR); Yannick Papi, Munchhouse (FR); Mathieu Mougey, Ensisheim (FR)

(73) Assignee: Behr France S.A.R.L., Rouffach (FR)

( * ) Notice: Subject to any disclaimer, the term of this patent is extended or adjusted under 35 U.S.C. 154(b) by 104 days.

(21) Appl. No.: 10/959,608

(22) Filed: Oct. 7, 2004

(65) Prior Publication Data

US 2005/0133490 A1 Jun. 23, 2005

(30) Foreign Application Priority Data

Oct. 7, 2003 (EP) ..... 03292475

(51) Int. Cl.
*H05B 3/06* (2006.01)
*H05B 3/02* (2006.01)

(52) U.S. Cl. ..... 219/540; 219/538

(58) Field of Classification Search ..... 219/540, 219/541, 536, 530, 537, 538, 542, 546, 548, 219/202

See application file for complete search history.

(56) References Cited

U.S. PATENT DOCUMENTS 5,192,853 A * 3/1993 Yeh ..... 219/540
5,206,476 A * 4/1993 Fresch et al. ..... 219/202

FOREIGN PATENT DOCUMENTS

| | | | |
|---|---|---|---|
| DE | 197 06 199 A1 | | 8/1998 |
| DE | 101 44 757 A1 | | 3/2003 |
| EP | 1 198 908 A1 | | 2/2002 |
| EP | 1182908 | * | 8/2002 |
| GB | 2 322 275 A | | 8/1998 |
| GB | 2322275 | * | 9/1998 |

* cited by examiner

*Primary Examiner*—Daniel L Robinson
(74) *Attorney, Agent, or Firm*—Foley & Lardner LLP

(57) ABSTRACT

A heating unit having a PTC element, in particular for a motor vehicle, with corrugated fins (6) arranged around the PTC element (2) for improved transfer of heat to air flowing through the heating unit. The heating unit has a plastic frame (7) which is of two-part design.

17 Claims, 8 Drawing Sheets

PTC HEATING UNIT SUITABLE FOR USE IN MOTOR VEHICLES

CROSS-REFERENCE TO RELATED PATENT APPLICATIONS

The right of foreign priority under 35 U.S.C. § 119(a) is claimed based upon European Patent Application No. 03 292 475.5, filed Oct. 7, 2003, the entire content of which is incorporated by reference, including the specification, drawings, claims and abstract.

BACKGROUND OF THE INVENTION

The invention relates to a heating unit having a PTC element, in particular a heating unit suitable for use in a motor vehicle.

DE 101 44 757 A1 discloses a passenger vehicle heating unit having a PTC element. It comprises a supplemental heating system having a heating element through which hot air flows during operation of the supplemental heating system, and it includes at least one air outlet opening in the foot region of a passenger compartment for dispensing the hot air. In order to be able to produce a vertical temperature stratification in the passenger compartment in a flexible manner, in particular such that the stratification is also perceived as pleasant in the rear seats, the heating element is designed as an electric PTC element arranged directly at the air outlet opening in the foot region. A supplemental heater of this type still leaves something to be desired. According to one disclosed exemplary embodiment, a PTC element in the form of a plurality of heating honeycombs is arranged in a plastic frame (not described in greater detail) which surrounds the air outlet opening.

SUMMARY OF THE INVENTION

It is therefore one object of the present invention to provide an improved heating unit having a PTC element.

In accordance with one aspect of the present invention, there has been provided a heating unit suitable for use in a motor vehicle, comprising: a PTC heating element; at least one heat transfer element arranged around the PTC element for improved transfer of heat to air flowing through the heating unit; and a plastic frame holding the PTC heating element and heat transfer elements, the plastic frame having a two-part design.

Further objects, features and advantages of the present invention will become apparent from the detailed description of preferred embodiments that follows, when considered in light of the accompanying figures of drawing.

BRIEF DESCRIPTION OF THE DRAWINGS

The invention is explained in detail below with reference a plurality of exemplary preferred embodiments and with reference to the drawings, in which:

FIG. 12 is a perspective view illustrating the heating unit of FIG. 8 with a cover partially pushed on.

DETAILED DESCRIPTION OF PREFERRED EMBODIMENTS

Figure 1:
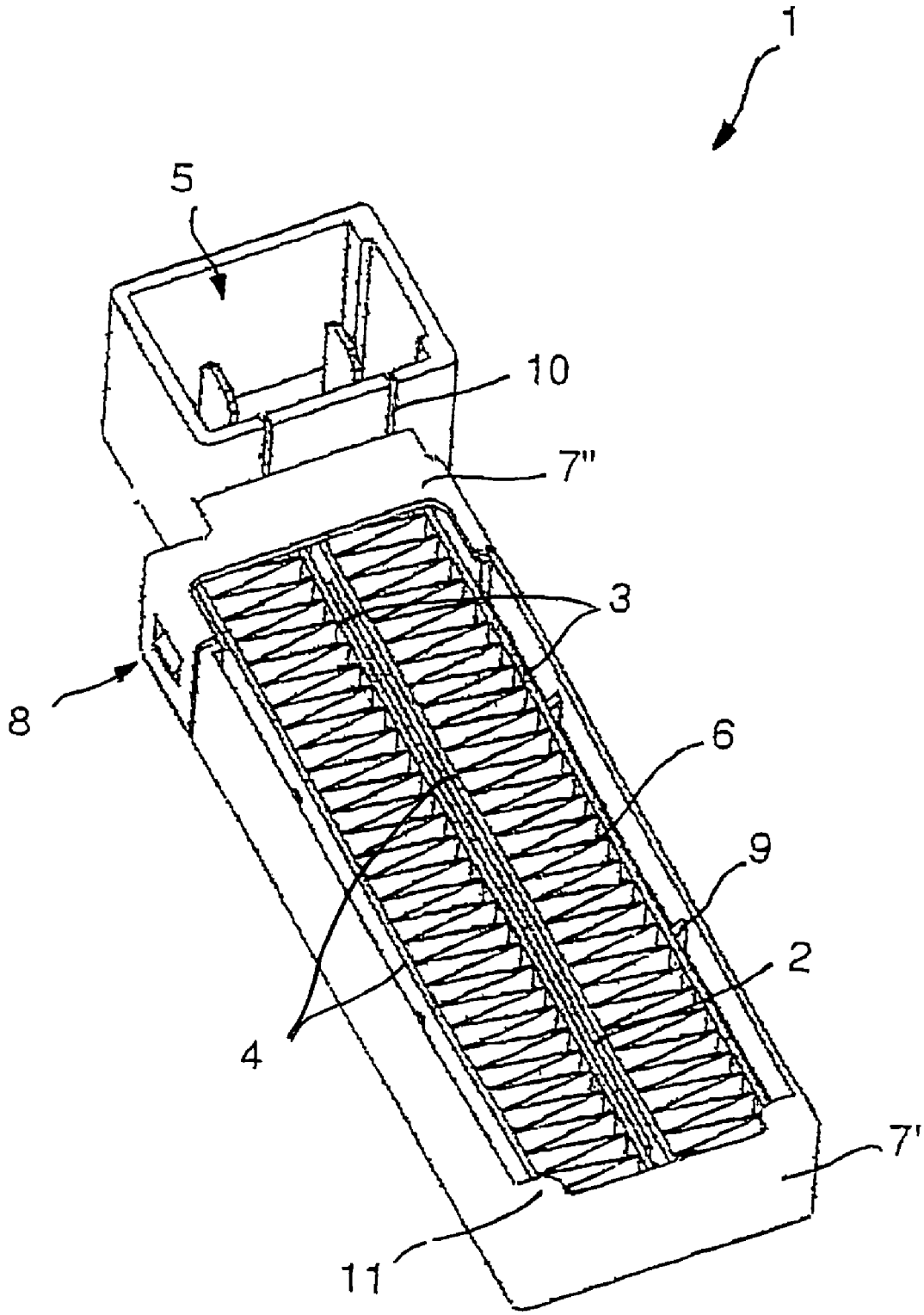
FIG. 1 is a perspective view showing a heating unit according to the first exemplary embodiment of the invention.

The present invention provides a heating unit having a PTC element, and a plastic frame which holds the PTC element and the heat transfer elements assigned to the element, wherein, the heat transfer elements preferably comprise corrugated fins. The plastic frame is of two-part design, in which the connection between the two parts of the plastic frame preferably takes place by means of a clip connection, but other connections, in particular a sliding connection, are also possible.

The plastic frame preferably has at least one opening, which in one preferred embodiment has two slots, for two contact plates. The plastic frame preferably has a portion, in the vicinity of the opening or the slots, designed as a electrical plug.

The plug is preferably formed at a right angle to the contact plates, in order to provide the electric contact. A cable and the plug are preferably aligned parallel to the direction of the air flow, which makes a simple, space-saving unit possible.

The PTC element is preferably attached to one of the contact plates by means of an adhesive joint. An adhesive joint of this type is simple to produce and forms a secure connection. A two-component silicone adhesive is preferably used. Contact plates that run parallel to each other are preferably attached on both sides of the PTC element.

A corrugated fin is also preferably attached on that side of the contact plate that faces away from the PTC element, preferably by means of an adhesive joint, in particular by means of a two-component silicone adhesive. Furthermore, an additional contact plate is preferably attached to the corrugated fin by means of an adhesive joint, on that side of the corrugated fin that faces away from the PTC element, preferably by means of a two-component silicone adhesive.

The two contact plates are preferably designed in such a manner that they form part of a plug, at their one end. This simplifies the assembly, since a plug does not have to be attached to the contact plates. For this purpose, the two contact plates are preferably of L-shaped design.

A tab for attaching the heating unit in or on an air duct is also preferably provided on the frame. The fastening can take place preferably by means of one or more screws or by means of a clip connection.

The frame is provided with one or more ribs which preferably run on the inner frame surface in the direction of the air flow. These serve, inter alia, to increase the stability of the frame, and to guide in the frame the heating unit comprised of the PTC element(s), the corrugated fins and the contact plates.

Turning now to the drawings, in the case of a single-stage PTC heating unit 1 according to the invention, the PTC element 2 is bonded in place between two contact plates 3 and 4, preferably by means of a two-component silicone adhesive.

The contact plate 3 is shown having an L-shaped design, forming part of a plug 5 at its angled end. The contact plate 4 is of essentially rectangular shape and is arranged parallel to the other contact plate 3.

Corrugated fins 6 are attached by means of a corresponding adhesive joint on those sides of the contact plates 3 and 4 which in each case face the PTC. element 2, and a respective further contact plate 3 and 4 is attached to said corrugated ribs, likewise again by means of a corresponding adhesive joint, these contact plates corresponding to the previously described contact plates 3 and 4.

A two-part plastic frame 7 is arranged around the previously described arrangement. A first frame part 7' has a rectangular region which holds the PTC element 2, the contact plates 3 and 4 and the corrugated fins 6. The first frame part 7' also includes a box-shaped region which is connected to the rectangular region and forms the outer part of the plug 5. The second frame part 7" of the plastic frame 7 is of C-shaped design and is fastened onto the first part 7', in one preferred embodiment by means of a clip connection 8. For this purpose, projections are provided on the two legs of the second part 7", with the projections projecting into corresponding openings provided in the first part 7', whereby a rapid and secure connection of the two parts 7' and 7" is made possible. The second part 7" ensures that the PTC unit is held securely in the plastic frame 7.

Figure 3:
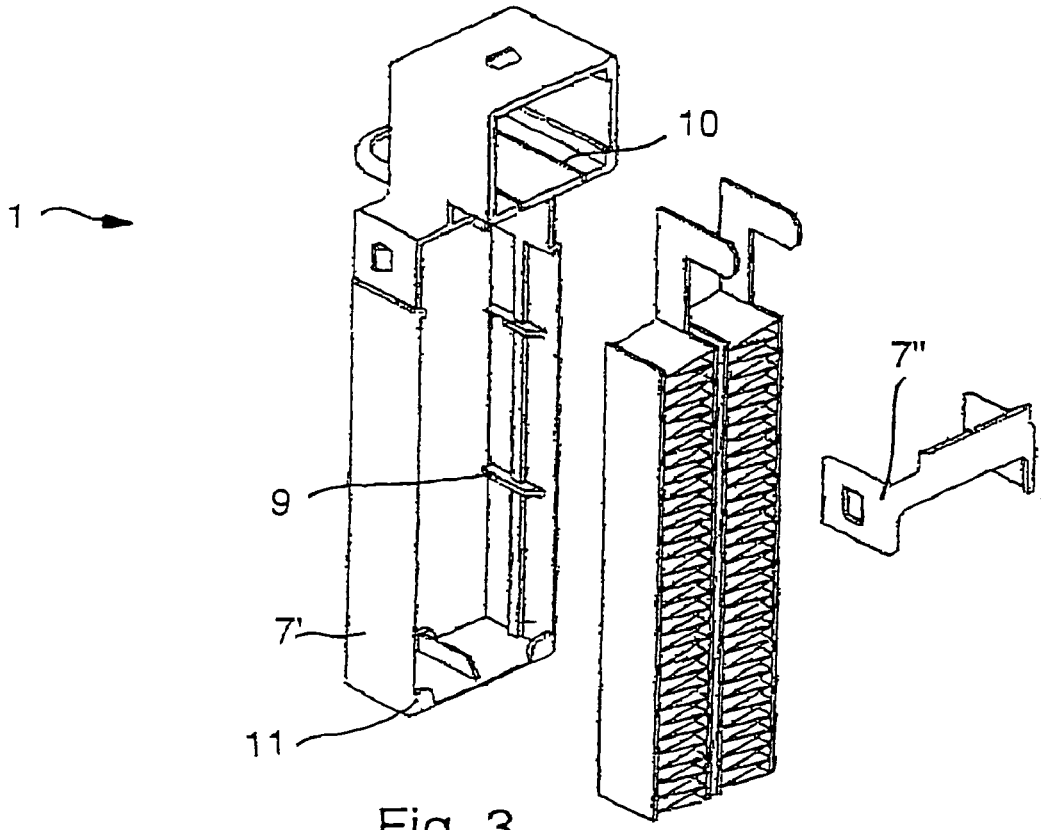
FIG. 3 is an exploded illustration showing the heating unit of FIG. 1.
Figure 5A:
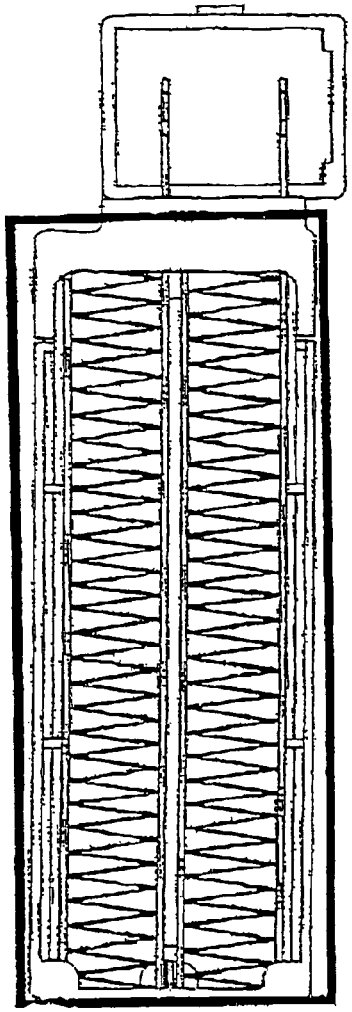
FIGS. 5*a* and 5*b* are perspective views showing an illustration of the integration in an air duct from different perspectives.
Figure 5B:
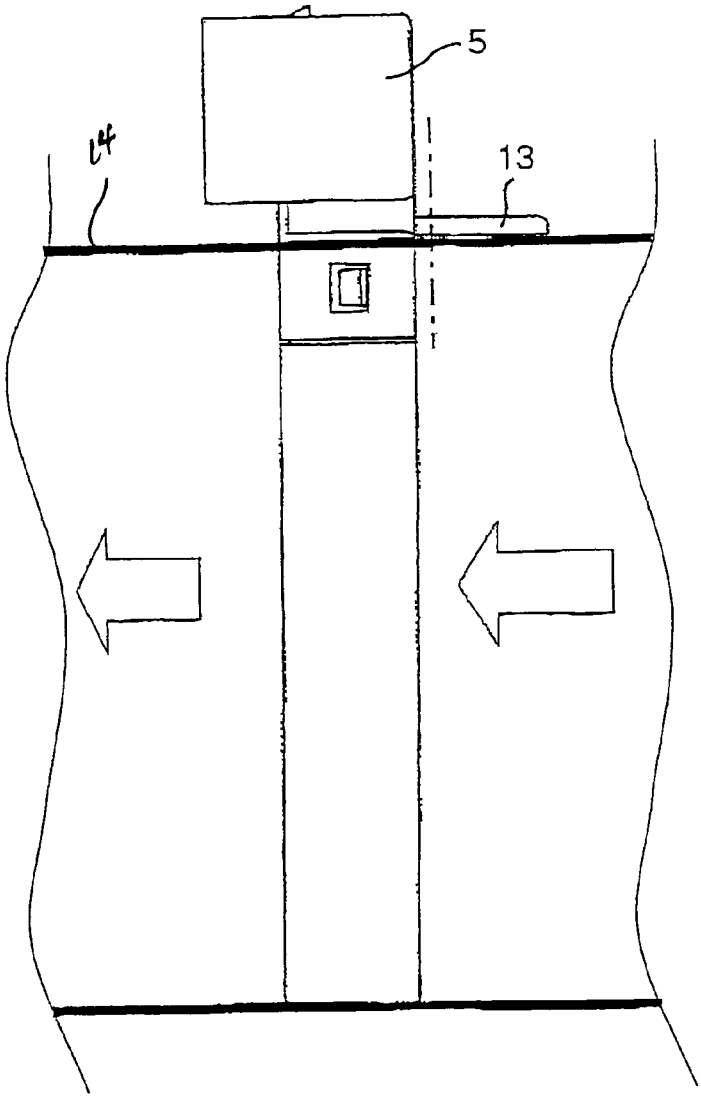
Figure 6:
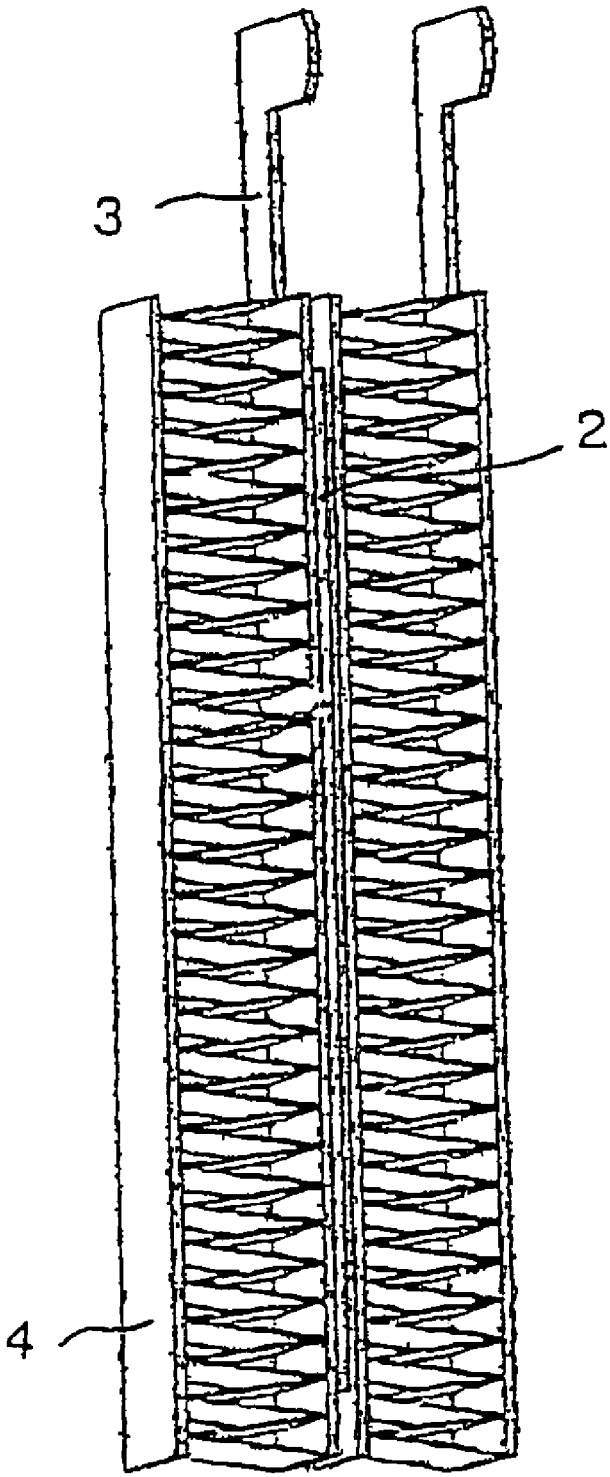
FIG. 6 is a perspective view showing a heating grid having a PTC element without a frame.
Figure 7A:
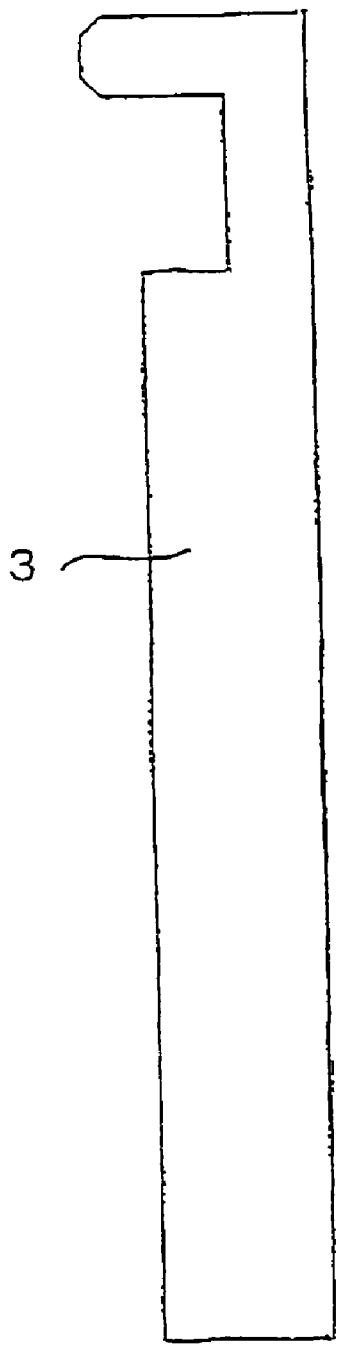
FIGS. 7*a* and 7*b* are perspective views showing the heating grid of FIG. 6 without a PTC element.
Figure 7B:
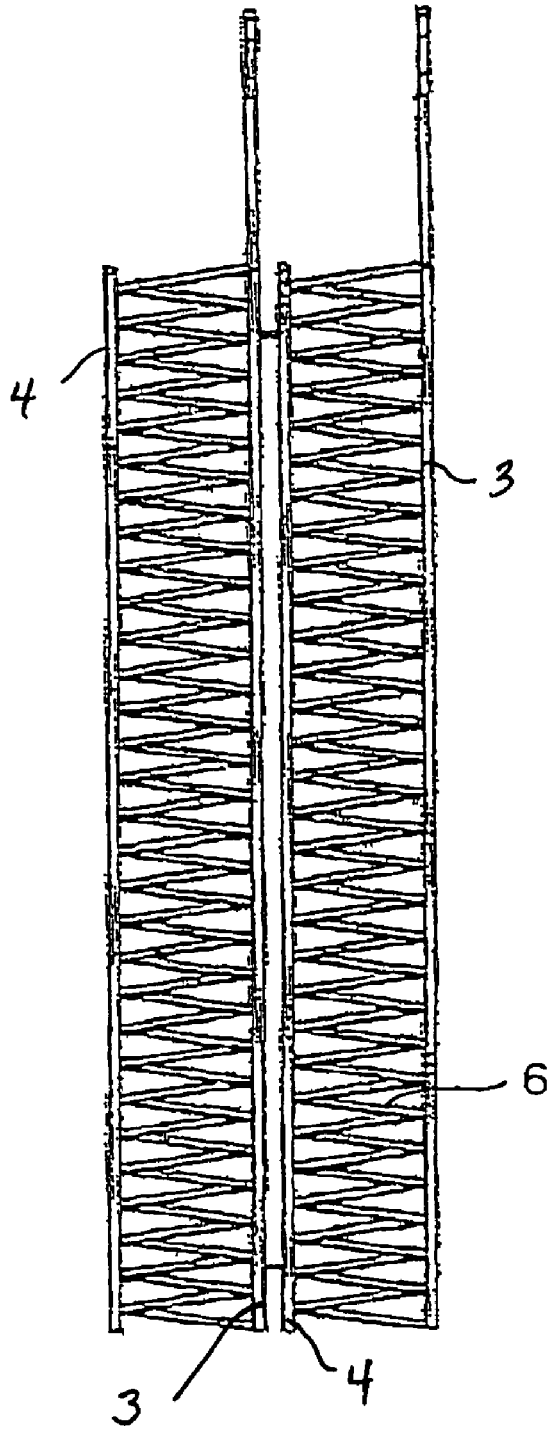
Figure 8:
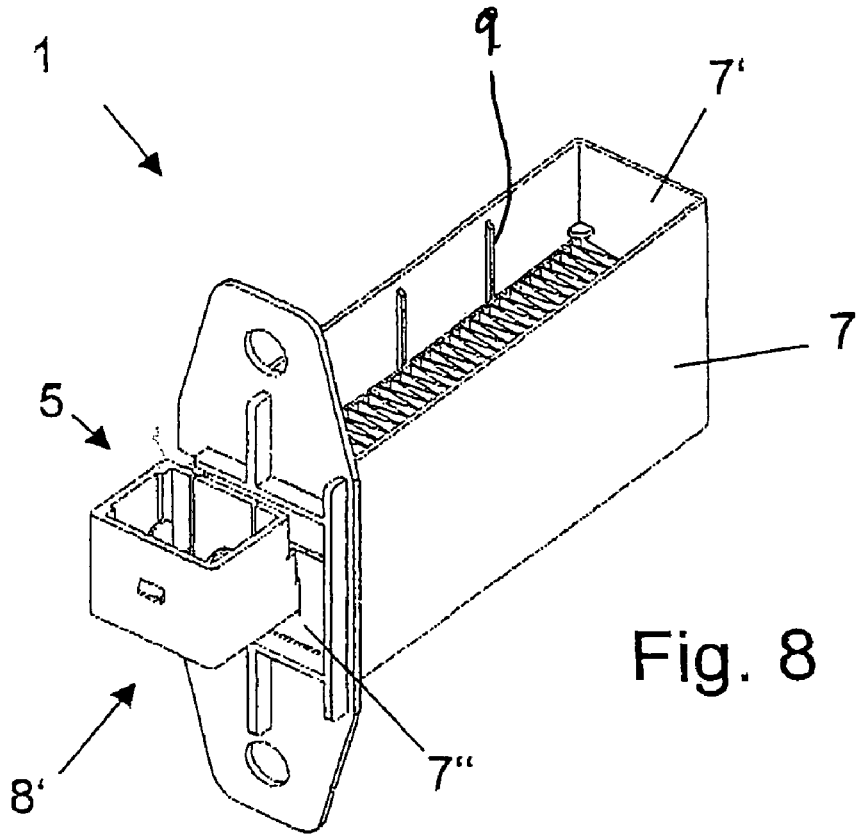
FIG. 8 is a perspective view showing a heating unit according to the second exemplary embodiment of the invention.
Figure 9:
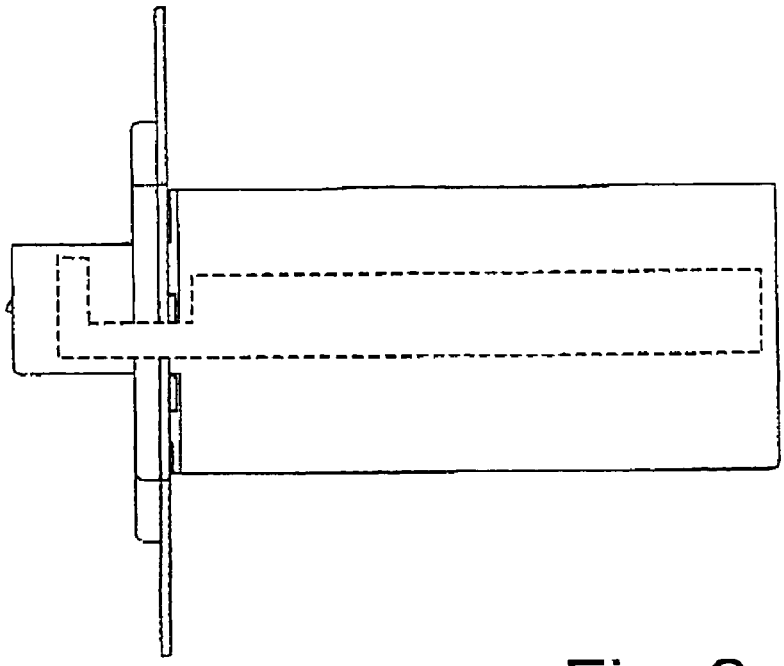
FIG. 9 is a longitudinal sectional view taken through the heating unit of FIG. 8.
Figure 10:
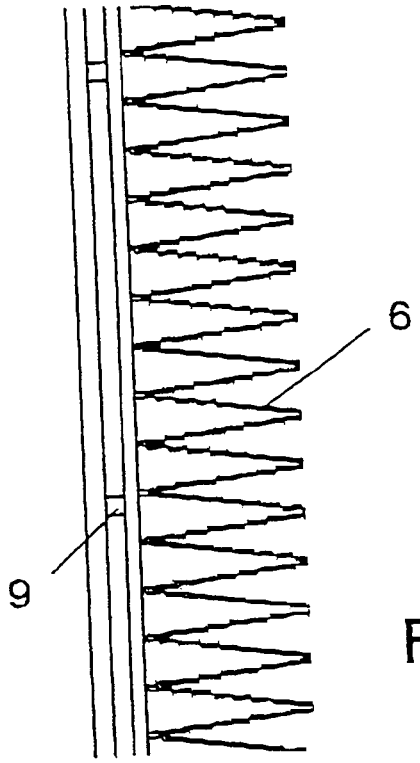
FIG. 10 is a detail view of a wall region.

One or more ribs 9 which run parallel to one another in the direction of the air flow are preferably arranged on the first part 7'. The direction of the air flow is indicated in FIG. 5*b* by arrows. The ribs 9 increase the strength of the plastic frame 7. Furthermore, two slot-shaped openings 10 which form a passage for the L-shaped contact plates 3 are provided in the end wall of the first part 7'. (FIG. 3)

Figure 2:
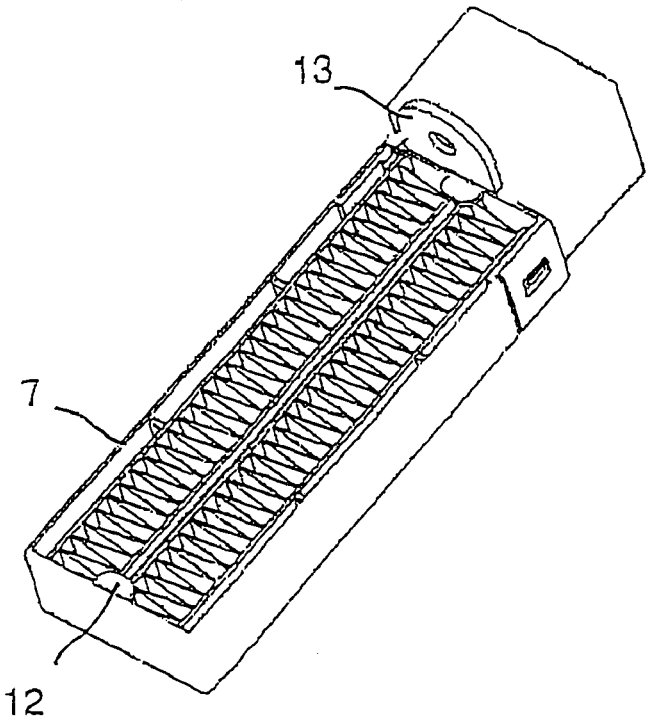
FIG. 2 is a different perspective view of the heating unit of FIG. 1.

Projections are preferably provided at one or more points around the periphery of the first part 7' to serve for supplementally fixing of the PTC unit in the PTC plastic frame 7, most preferably in the form of projections 11 located at the two corners which are at the opposite end from the plug 5, in order to facilitate insertion of the PTC heating device into the frame. According to another preferred design, the projections are formed as two projections 12 provided on the underside of the part 7', arranged centrally in the longitudinal axis of the part 7', as can be seen in FIG. 2. These projections serve to position the unit in the plastic frame 7 in the appropriate direction. The plastic frame 7 furthermore preferably has an attachment member, preferably in the form of a tab 13 which is arranged on the part 7',and serves (see FIGS. 2 and 5*b*) for fastening the heating unit in an air duct 14 by means, e.g., of a screw (not illustrated). As another alternative, the fastening can take place, for example, by means of a clip connection or any other comparable means of attachment.

Figure 4:
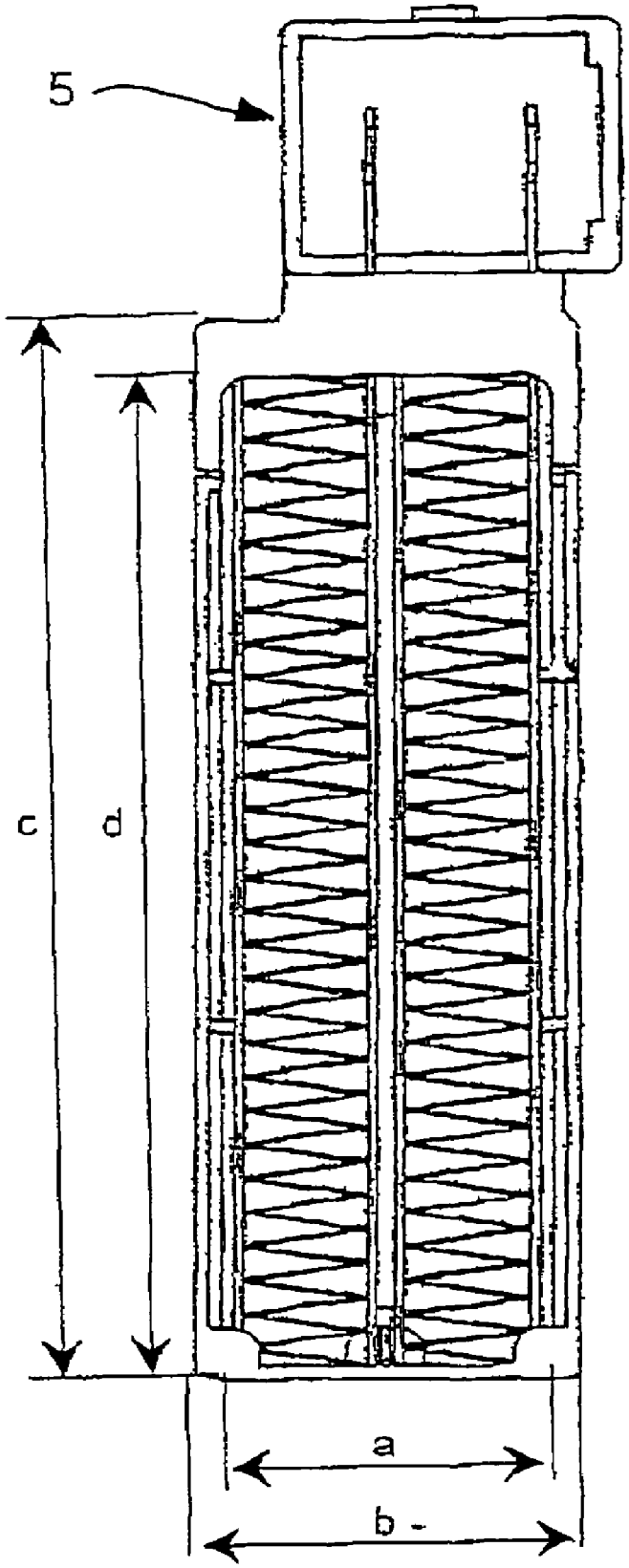
FIG. 4 is a plan view of the heating unit of FIG. 1.

As is apparent from FIG. 4, the ratio of the free area (which corresponds approximately to a×d) to the entire area b×c is relatively large, so that the drop in pressure in the air duct is relatively small and hence a relatively small fan power is required. In this case, "a" corresponds to the width through which the flow can take place, "b" corresponds to the entire width, "c" corresponds to the entire length and "d" corresponds to that length of the heating unit 1, without the plug 5, through which the flow can take place. In the preferred embodiment illustrated, the ratio of a×d to b×c is approximately 84%.

The heating unit having a PTC element is preferably arranged as a decentralized supplemental heater located outside the air conditioning unit, for example in corresponding air ducts in the A-pillar, B-pillar, C-pillar and/or in a door.

The second exemplary embodiment described below with reference to FIGS. 8 to 12 corresponds essentially to the previously described, first exemplary embodiment, with the result that elements that are identical and act in an identical manner are provided with the same reference numbers.

Figure 11:
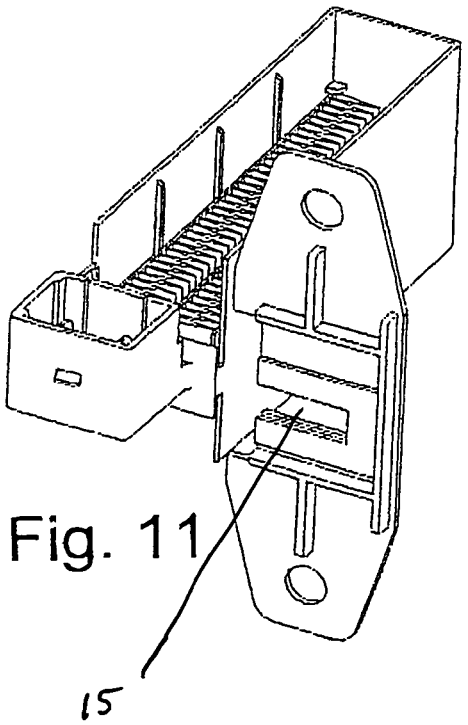
FIG. 11 is an exploded illustration showing the heating unit of FIG. 8.
Figure 12:
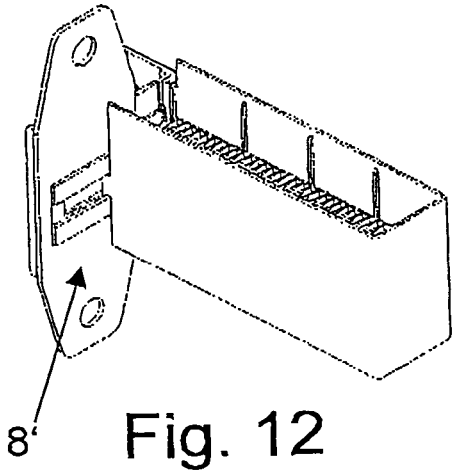

The unit, comprised of two contact plates 3, 4 positioned in a two-part plastic frame 7, comprising a first part 7' and a second part 7", corresponds to that of the first exemplary embodiment, but the frame 7 has a sliding connection 8' instead of a clip connection 8, as can be gathered in particular from FIG. 11. In this embodiment, an appropriately designed slot 15 is provided in the second part 7" and is slid laterally over a constriction of the first part 7' between the region holding the PTC element 2, the contact plates 3, 4 and the corrugated fins 6, and the region housing plug 5. As a result, the heating unit 1 is securely held together.

Corresponding to the first exemplary embodiment, ribs 9 are provided in the frame 7. These ribs bring about a spacing between the heating elements (which are also understood below to include the contact plates 3, 4 and the corrugated fins 6), and the frame 7, thereby reducing the heat load on the frame 7. The frame 7 consists of a plastic with increased thermal stability, such as, for example, a polyamide or other well known heat-resistant plastic materials. Furthermore, the frame 7 itself forms an insulating wall, so that the heat loss is kept as small as possible, and adjacent components, for example, seat belts, are not adversely affected or damaged by the increased temperature in the event that the supplemental heating is used. The insulating wall and/or a second insulating wall in addition to the frame may also be formed separately.

As a further measure for protecting against overheating, according to the second exemplary embodiment, PTC elements 2 which have an operating temperature of between 80° C. and 120° C. are selected, in contrast to the conventional PTC elements having a surface temperature of 130° C. to 165° C. Corresponding protection may also be achieved by the use of a regulator which, when a certain temperature is reached in the environment of the heating unit, reduces the power or completely shuts off the power supply temporarily.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heating unit suitable for use in a motor vehicle, comprising:

a PTC heating element;

at least one heat transfer element arranged around the PTC element for improved transfer of heat to air flowing through the heating unit; and a plastic frame holding the PTC heating element and heat transfer elements, said plastic frame having a two-part design wherein a first part of the two-part design comprises four sides of the plastic frame;

wherein the PTC element is attached to a contact plate by an adhesive;

wherein the heat transfer elements comprise at least one corrugated rib attached by an adhesive on the side of the contact plate which faces away from the PTC element; and wherein a further contact plate is attached to the corrugated rib by an adhesive on that side of the corrugated rib which faces away from the PTC element.

2. A heating unit as claimed in claim 1, wherein the two parts of the plastic frame are connected to each other by means of a clip connection or a sliding connection.

3. A heating unit as claimed in claim 1, further comprising two electrical contact plates connected to the PTC heating element, and wherein the plastic frame has at least a first opening for the two contact plates and includes, in the vicinity of the first opening or openings, a plug.

4. A heating unit as claimed in claim 3, wherein the plug is formed at a right angle to the contact plates, the plug being aligned parallel to the direction of air flow through the heating unit.

5. A heating unit as claimed in claim 3, wherein contact plates are attached on both sides of the PTC element.

6. A heating unit as claimed in claim 3, wherein two contact plates are shaped at one end as part of a plug.

7. A heating unit as claimed in claim 1, wherein the two contact plates have an L shaped design.

8. A heating unit as claimed in claim 1, wherein the frame further comprises an attachment member for attaching the heating unit in or on an air duct.

9. A heating unit as claimed in claim 1, wherein the inside of the frame further comprises one or more ribs running in the direction of air flow.

10. A heating unit as claimed in claim 1, wherein the heating unit is designed as a decentralized supplemental heater which is installable in an air duct positioned away from an air conditioning unit.

11. A heating unit as claimed in claim 3, wherein at least two of said elements are bonded by a two-component silicone adhesive.

12. A heating unit as claimed in claim 1, wherein the plastic frame is manufactured from a thermally stable plastic.

13. A heating unit as claimed in claim 1, wherein the plastic frame forms an insulating wall or is provided with insulation.

14. A heating unit as claimed in claim 1, wherein the heating unit has PTC elements having an operating temperature of 80° C. to 120° C.

15. A heating unit as claimed in claim 1, further comprising a relay or regulator for controlling the heating unit.

16. A heating unit as claimed in claim 1, wherein the two parts of the plastic frame lock together in a configuration that serves to maintain the at least one heat transfer element in the plastic frame.

17. A heating unit suitable for use in a motor vehicle, comprising:

a PTC heating element;

at least one heat transfer element arranged around the PTC element for improved transfer of heat to air flowing through the heating unit; and a plastic frame holding the PTC heating element and heat transfer elements, said plastic frame having a two-part design wherein the two parts of the plastic frame are clipped together and wherein the direction of clipping is parallel to the direction of air flowing through the heating unit;

wherein the PTC element is attached to a contact plate by an adhesive;

wherein the heat transfer elements comprise at least one corrugated rib attached by an adhesive on the side of the contact plate which faces away from the PTC element; and wherein a further contact plate is attached to the corrugated rib by an adhesive on that side of the corrugated rib which faces away from the PTC element.

* * * * *